United States Patent [19]

Franklin

[11] Patent Number: 4,848,095

[45] Date of Patent: Jul. 18, 1989

[54] COOL TANK CONSTRUCTION FOR EUTECTIC SOLUTION AND $CO_2$ SNOW

[76] Inventor: Paul R. Franklin, P.O. Box 37978, Jacksonville, Fla. 32205

[21] Appl. No.: 190,109

[22] Filed: May 4, 1988

[51] Int. Cl.[4] ..... F28C 1/00

[52] U.S. Cl. ..... 62/121; 62/59; 62/307; 62/384; 62/388; 62/434

[58] Field of Search ..... 62/384, 388, 121, 307, 62/430, 434, 59, 306

[56] References Cited

U.S. PATENT DOCUMENTS

| | | | |
|---|---|---|---|
| 1,712,701 | 5/1929 | Hassensall | 62/306 |
| 2,759,336 | 8/1956 | Seefeldt | 62/307 X |
| 4,022,119 | 5/1977 | Karr | 62/307 X |
| 4,094,164 | 6/1978 | Cope | 62/121 X |
| 4,404,818 | 9/1983 | Franklin, Jr. | 62/384 |
| 4,502,293 | 3/1985 | Franklin, Jr. | 62/388 |

*Primary Examiner*—Lloyd L. King

*Attorney, Agent, or Firm*—Fleit, Jacobson, Cohn, Price, Holman & Stern

[57] ABSTRACT

A vented cold tank is provided and partially filled with a eutectic solution. $CO_2$ snow forming structure is provided within the interior of the tank above the level of the eutectic solution therein and liquid $CO_2$ injection means is provided in a lower portion of the tank below the level of eutectic solution and arranged to create circulation of the eutectic solution within the tank including generally opposite horizontal and generally opposite vertical component of movement of the solution within the tank. Further, structure is provided for communicating the $CO_2$ snow forming means and the liquid $CO_2$ injection means with the same source of liquid $CO_2$ under pressure.

10 Claims, 1 Drawing Sheet

COOL TANK CONSTRUCTION FOR EUTECTIC SOLUTION AND $CO_2$ SNOW

BACKGROUND OF THE INVENTION

1. Field of the Invention

This invention relates to a closed, but vented, receptacle constructed of good heat transfer material and partially filled (approximately one-third) with a eutectic solution. The upper portion of the interior of the receptacle includes $CO_2$ spray head structure for forming $CO_2$ snow therein and which may fall down upon the surface of the eutectic solution and the lower portion of the interior of the receptacle includes structure for pressure jet discharge of liquid $CO_2$ thereinto adjacent the bottom of the receptacle, the liquid $CO_2$ flow capacity of the pressure jet discharge structure and the lower portion of the interior of the receptacle being appreciably more than the liquid $CO_2$ flow capacity of the $CO_2$ spray head structure and the jet discharge structure being arranged to effect a circulatory movement of the solution within the tank including generally opposite longitudinal and generally opposite vertical improvements of movement.

2. Description of Related Art

Many enclosed containers heretofore have been provided into which liquid $CO_2$ may be spray discharged for forming $CO_2$ snow within the containers. In addition, cooling containers for chilled eutectic solutions also have been provided as well as cooling containers having transfer passages formed therein. However, the cold tank of the instant invention provides a closed container (but having its upper portion vented to the exterior) to be partially filled with a eutectic solution and into whose upper portion liquid $CO_2$ may be spray discharged for forming snow within the receptacle upper portion, the snow falling down within the receptacle onto the surface of the eutectic solution. Further, the container also includes spray jet discharge structure within a lower portion thereof below the surface of the eutectic solution through which an appreciably larger quantity of liquid $CO_2$ may be discharged into the eutectic solution, the spray discharge of liquid $CO_2$ into the eutectic solution being rapidly transformed into $CO_2$ snow for suspension in and chilling the eutectic solution as well as a small quantity of $CO_2$ gas which may rise through the eutectic solution to the surface thereof.

The injection of liquid $CO_2$ into the eutectic solution causes sufficient circulation of the eutectic solution within the lower portion of the receptacle to cause the snow falling to the surface of the solution to be blended therein, thereby more rapidly chilling the eutectic solution down to a point elevated only slightly above its freezing point.

By this method, the heat absorbing capacity of a given amount of liquid $CO_2$ is increased over presently known and used methods of chilling a cold tank or the like.

SUMMARY OF THE INVENTION

The cold tank of the instant invention is approximately one-third filled with a eutectic solution comprising, for instance, a 3:1 mixture of water and propylene glycol having a freezing temperature of approximately −20° F. Liquid $CO_2$ is spray discharged into the upper portion of the interior of the receptacle above the level of eutectic solution therein while at the same time liquid $CO_2$ is injected into a lower portion of the interior little receptacle below the eutectic level.

By using this method of chilling a cold tank an appreciably greater heat absorbing capacity is obtained through the use of the same amount of liquid $CO_2$ and the tank and solution are more rapidly chilled.

The main object of this invention is to provide a more efficient cold tank.

Another object of this invention is to provide a more efficient cold tank which may be produced as a totally new product or a retrofitted older and less efficient cold tank.

Another object of this invention is to provide a cold tank of improved operation and which may incorporate otherwise old and operationally dependable cold tank structure.

A final object of this invention to be specifically enumerated herein is to provide a cold tank in accordance with the preceding objects and which will conform to conventional forms of manufacture, be of simple construction and dependable in operation so as to provide a device which will be economically feasible, long-lasting and relatively trouble free in operation.

These together with other objects and advantages which will become subsequently apparent reside in the details in construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
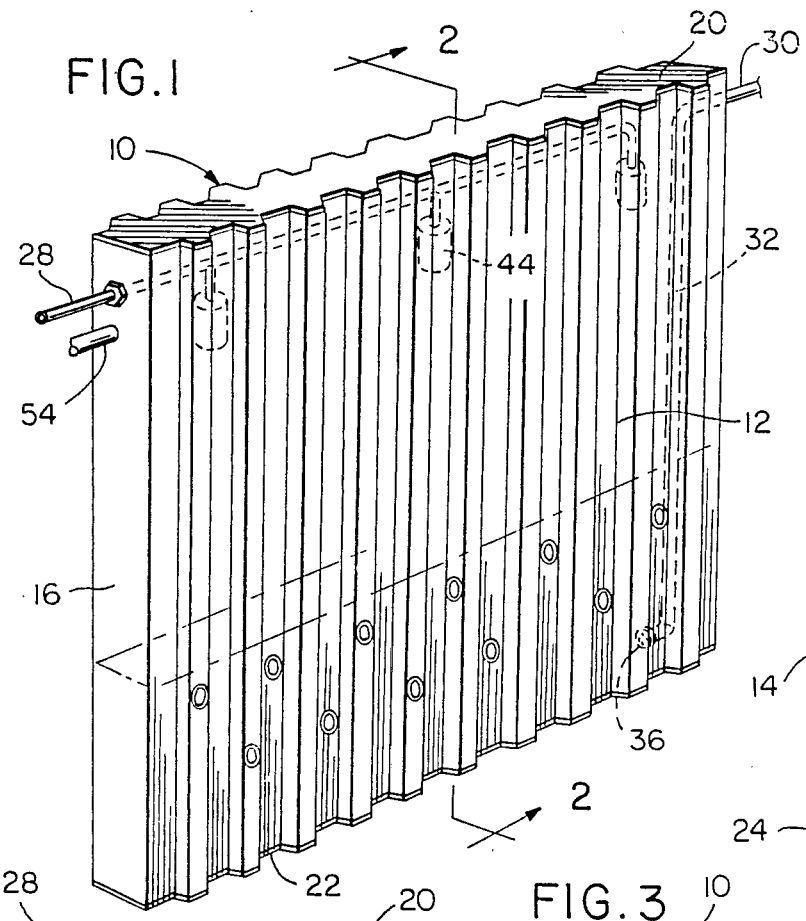
FIG. 1 is a perspective view of a cold tank constructed in accordance with the present invention.
Figure 2:
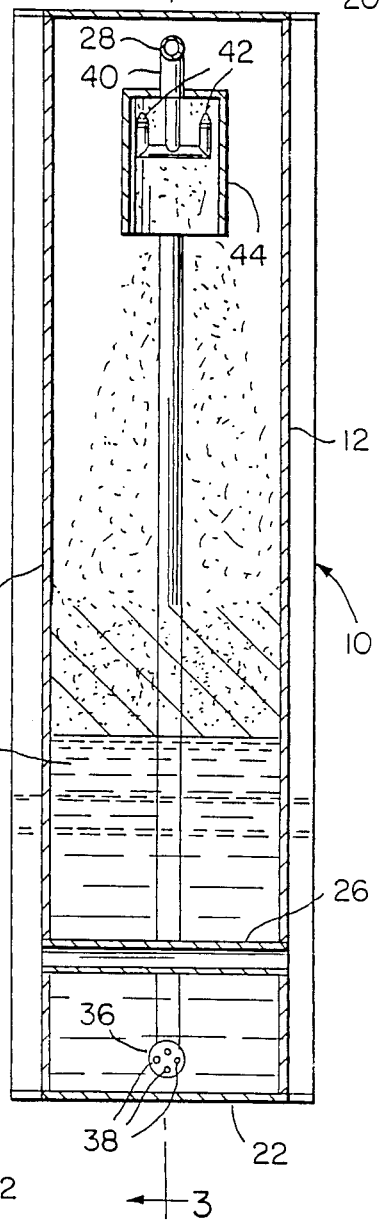
FIG. 2 is an enlarged fragmentary transverse vertical sectional view taken substantially upon a plane indicated by the section line 2—2 of FIG. 1.

Referring now more specifically to the drawings the numeral 10 generally designates a cold tank constructed in accordance with the present invention.

The cold tank 10 includes large area opposite side walls 12 and 14 and smaller area opposite end walls 16 and 18. The end walls 16 and 18 interconnect corresponding ends of the side walls 12 and 14 and the latter include vertically extending corrugations to increase the surface area thereof. Further, top and bottom walls 20 and 22 extend between and interconnect the upper marginal portions of the walls 12, 14, 16 and 18.

The interior of the tank 10 is approximately one-third filled with any suitable eutectic solution 24 and the lower portion of the tank 10 includes transversely extending heat exchange air-flow tubes 26 extending between and sealingly secured through the side walls 12 and 14.

A liquid $CO_2$ header pipe 28 is disposed in the upper portion of the tank 10 and extends longitudinally thereof. The header pipe 28 opens through the end wall 16 from a suitable supply of liquid $CO_2$ under pressure. Further, a $CO_2$ supply line for pipe 30 enters into the upper portion of the interior of the tank 10 through the end wall 18 and is immediately directly downwardly as 32 to a position closely adjacent the bottom wall 22. The lower end of the supply line 30 includes a horizontally directed terminal end 34 and the terminal end 34 terminates in an end fitting 36 including a plurality (four) of small diameter outlet openings 38 formed therein. The supply line 30 receives its liquid $CO_2$ from the same supply (not shown) thereof to which the header pipe 28 is connected. The supply (not shown) of liquid $CO_2$ is under approximately 300 pounds pressure per square inch.

Figure 3:
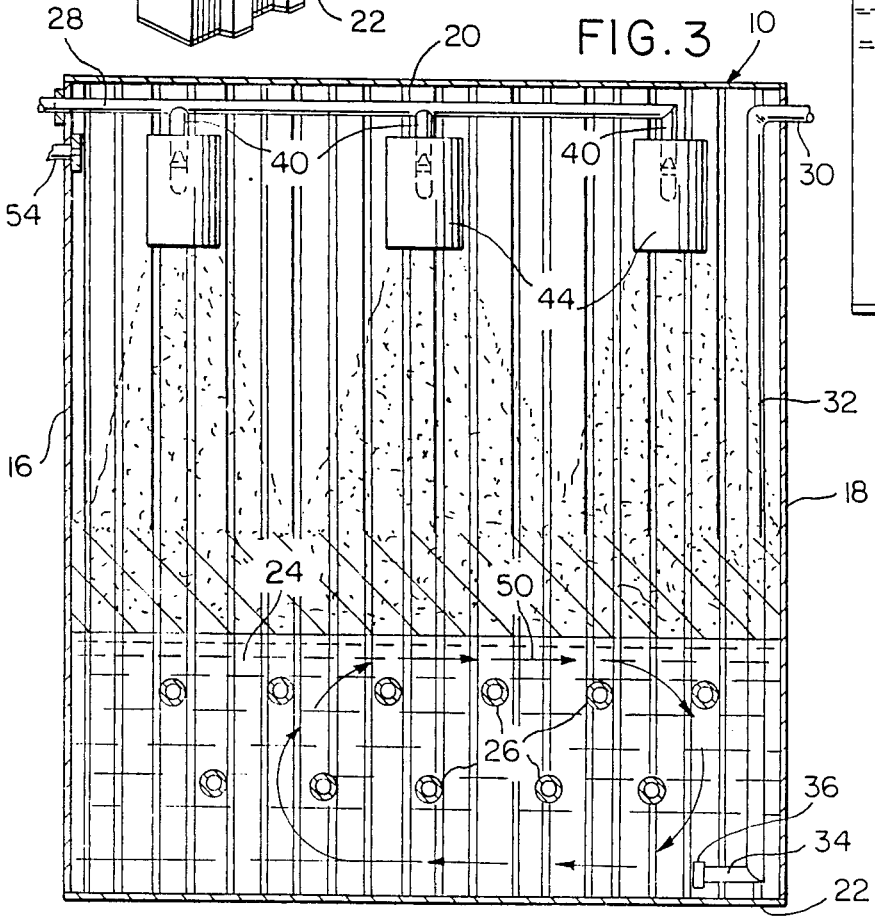
FIG. 3 is a vertical sectional view taken substantially upon the plane indicated by the section line 3—3 of FIG. 2.

The header pipe 28 includes a plurality of downwardly directed discharge lines 40 spaced therealong and each discharge line 40 is communicated with one or more spray discharge outlets 42 disposed within a downwardly opening horn 44. Spray discharge of liquid $CO_2$ under pressure from the outlets 42 results in $CO_2$ snow being formed within the horns 44 and dropping downwardly onto the surface of the eutectic solution 24. In addition, spray discharge of liquid $CO_2$ from the outlet openings 38 results in some of the discharged liquid $CO_2$ being directly converted into $CO_2$ snow while the remaining amount of discharged $CO_2$ is transformed into $CO_2$ gas. In any event, a circulatory motion such as that indicated at 50 in FIG. 3 is caused within the lower third of the tank 10 containing the eutectic solution 24.

Conventionally, $CO_2$ snow may be discharged on top of a chilled eutectic solution and in some instances it is believed that $CO_2$ may have been spray discharged into a chilled eutectic solution for cooling thereof.

The cooling tank 10 is primarily designed to be used in insulated truck bodies (although the tank 10 may be exteriorly mounted) and a certain amount of time is required together with a certain amount of liquid $CO_2$ in order to fully chill the tank 10 and the eutectic solution 24.

By the instant invention, the amount of time required is substantially reduced and the amount of liquid $CO_2$ required is appreciably reduced. By jet discharging liquid $CO_2$ from the outlets 38, the circulatory movement 50 of the eutectic solution 24 is created and at the same time $CO_2$ snow formed in the horns 44 drops down upon the surface of the eutectic solution 24. The circulatory movement 50 is such that the snow dropping down upon the surface of the eutectic solution 24 is circulated through the lower portion of the tank 10 with the circulating eutectic solution 24 thus more quickly chilling the eutectic solution 24 and minimizing the build up of the snow on top of the surface of the eutectic solution 24.

Also, when the eutectic solution 24 has been sufficiently chilled to form a slush-like mixture, the desired chilling operation is almost completely accomplished and the discharge of liquid $CO_2$ from the outlets 38 is automatically slowed by the resistance of the slush-like mixture against which the liquid $CO_2$ is being discharged through the outlets 38. At this point, snow will begin to build up on the surface of the eutectic solution 24 and the supply of liquid $CO_2$ to the cooling tank 10 soon must be terminated.

If the liquid $CO_2$ is discharged only into the eutectic solution 24, soon after the eutectic solution 24 forms a slush-like mixture (as it approaches its freezing temperature) the line pressure within the line 30 will build up due to the resistance of the discharge of liquid $CO_2$ against the slush-like mixture through the outlet opening 38. This build up of line pressure can cause portions of the line 30 to rupture. Accordingly, when the same supply of liquid $CO_2$ is utilized to supply the line 30 and the header pipe 28, even though the resistance to the discharge of liquid $CO_2$ from the outlet opening 38 is increased, the liquid $CO_2$ from the aforementioned pressurized supply thereof may still experience pressure relief through the spray outlets 42, thereby preventing rupture of the supply line 30 in the event a person controlling the valves supplying liquid $CO_2$ to the header pipe 28 and the supply line 30 is inattentive to his job at the time the eutectic solution 24 reaches the aforementioned slush-like condition.

Accordingly, by discharging $CO_2$ snow onto the surface of the eutectic solution 24 during primary cooling thereof as a result of liquid $CO_2$ being discharged directly into the eutectic solution 24 from the outlet opening 38, the chilling action on the eutectic solution 24 is accelerated (resulting in a considerable savings of time) and the danger of rupture of the supply line 30 is substantially eliminated as a result of an inattentive person controlling the valve structure through which liquid $CO_2$ is supplied to the header pipe 28 and the supply line 30.

The tubes 26 are not in themselves novel, but they increase the surface area for cooling purposes and more importantly, brace the side walls 12 and 14 relative to each other in order to prevent a build up of pressure within slush-like eutectic solution being sufficient to outwardly bow the side walls 12 and 14 before the supply of liquid $CO_2$ to the tank 10 is terminated. Accordingly, although the overall tank construction of the instant invention is generally similar to the tanks disclosed in my prior U.S. Pat. Nos. 4,404,818 and 4,502,293 (the latter patent disclosing the equivalent of the tubes 26), the tubes 26 perform a dual function in the instant invention, the upper portion of the interior of the tank 10 being vented as at 54.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cold tank including a quantity of eutectic solution therein to a level appreciably below the top of the tank, $CO_2$ snow forming means in an upper portion of said tank operative to form $CO_2$ snow within the tank above the level of eutectic solution therein for falling of the $CO_2$ snow by gravity down onto the surface of said eutectic solution, liquid $CO_2$ injection means disposed in said tank below said surface and operative to effect a circulatory movement of said solution within said tank including generally opposite horizontal and generally opposite vertical components of movement of said solution within said tank, and means for supplying liquid $CO_2$ under pressure to said $CO_2$ snow forming means and said liquid $CO_2$ injection means from the same source of liquid $CO_2$ under pressure and in a manner allowing said $CO_2$ snow forming means to constitute a pressure relief of said liquid $CO_2$ source as excess resistance to the discharge of liquid $CO_2$ from said liquid $CO_2$ injection means into said solution is encountered as a result of said solution being chilled to a slush-like state.

2. The cold tank of claim 1 wherein said tank includes large plan area upstanding opposite side walls interconnected by smaller plan area opposite end walls, and a plurality of air circulation tubes extending between and sealingly secured through said side walls below said surface and performing the additional function of relatively reinforcing said side walls against being outwardly bowed due to an increase of pressure within said solution as a result of continued discharge of liquid $CO_2$ from said injection means subsequent to said solution being chilled to a slush-like state.

3. The cold tank of claim 2 wherein said side walls include vertically extending corrugations serving not only to increase the surface area thereof, but also to provide additional reinforcing against outward bowing of said side walls due to excess pressure within said tank below said level.

4. The cold tank of claim 1 wherein the flow rate of liquid $CO_2$ through said injection means is greater than the flow rate of liquid $CO_2$ through said snow forming means.

5. The cold tank of claim 2 wherein said tank includes top and bottom walls extending between and interconnecting upper and lower marginal edge portions of said side and end walls, said injection means including means for injecting liquid $CO_2$ into said eutectic solution horizontally along said bottom wall from a point adjacent one end wall and in a direction extending toward the other end wall.

6. The cold tank of claim 1 including means venting the interior of said tank above said surface to the exterior of said tank.

7. The cold tank of claim 1 wherein the flow rate of liquid $CO_2$ through said injection means is greater than the flow rate of liquid $CO_2$ through said snow forming means, said side walls including vertically extending corrugations serving not only to increase the surface area thereof, but also to provide additional reinforcing against said side walls being outwardly bowed due to excess pressure within said tank below said level.

8. The cold tank of claim 7 wherein said tank includes large plan area upstanding opposite side walls interconnected by smaller plan area opposite end walls, and a plurality of air circulation tubes extending between and sealingly secured through said side walls below said surface and performing the additional function of relatively reinforcing said side walls against being outwardly bowed due to an increase of pressure within said solution as a result of continued discharge of liquid $CO_2$ from said injection means subsequent to said solution being chilled to a slush-like state.

9. The cold tank of claim 8 wherein said tank includes top and bottom walls extending between and interconnecting upper and lower marginal edge portions of said side and end walls, said injection means including means for injecting liquid $CO_2$ into said eutectic solution horizontally along said bottom wall from a point adjacent one end wall and in a direction extending toward the other end wall.

10. The method of rapidly and safely cooling a liquid eutectic solution to a slush-like mixture within a cold tank having said eutectic solution therein to a level spaced appreciably below the upper extremity of the interior of said tank, said method comprising providing $CO_2$ snow forming means within said tank above said level operative to form $CO_2$ snow upon being supplied liquid $CO_2$ under pressure and for gravity falling of the $CO_2$ snow formed thereby down onto the surface of said liquid eutectic solution, providing liquid $CO_2$ injection means within said tank below said level and arranged therein to create circulation of said liquid eutectic solution within said tank including generally opposite horizontal and generally opposite vertical components of movement of said solution within said tank, communicating said $CO_2$ snow forming means and said liquid $CO_2$ injection means with liquid $CO_2$ under pressure from the same source of liquid $CO_2$ for a period of time sufficient to chill said eutectic solution to a slush-like state, thereby substantially preventing further circulation of the chilled eutectic solution, and thereafter waiting a short predetermined time before terminating the supply of liquid $CO_2$ to said $CO_2$ snow forming means and said liquid $CO_2$ supplied to said liquid $CO_2$ injection means, during which short predetermined time the majority of liquid $CO_2$ supplied to said liquid $CO_2$ injection means and said $CO_2$ snow forming means passes through the latter and results in a $CO_2$ snow layer buildup upon the surface of said chilled slush-like eutectic solution.

* * * * *